US005187535A

United States Patent [19]

Tajima

[11] Patent Number: 5,187,535

[45] Date of Patent: Feb. 16, 1993

[54] IMAGE FORMING APPARATUS

[75] Inventor: Hatsuo Tajima, Matsudo, Japan

[73] Assignee: Canon Kabushiki Kaisha, Tokyo, Japan

[21] Appl. No.: 846,067

[22] Filed: Mar. 5, 1992

[30] Foreign Application Priority Data

Mar. 5, 1991 [JP] Japan ..... 3-038662

[51] Int. Cl.[5] ..... G03G 15/01

[52] U.S. Cl. ..... 355/326; 118/647; 118/651; 346/157; 355/246; 355/327

[58] Field of Search ..... 355/326, 327, 328, 246, 355/32, 261, 265, 266; 118/647, 651; 346/157

[56] References Cited

U.S. PATENT DOCUMENTS

| | | | |
|---|---|---|---|
| 4,383,497 | 5/1983 | Tajima | 118/651 |
| 4,679,929 | 7/1987 | Haneda et al. | 355/326 X |
| 4,873,551 | 10/1989 | Tajima et al. | 355/251 |
| 5,030,996 | 7/1991 | Tajima et al. | 355/246 |

FOREIGN PATENT DOCUMENTS

| | | | |
|---|---|---|---|
| 0151874 | 7/1987 | Japan | 355/326 |
| 0210861 | 9/1988 | Japan | 355/326 |
| 0300269 | 12/1989 | Japan | 355/326 |
| 0186370 | 7/1990 | Japan | 355/326 |
| 0067278 | 3/1991 | Japan | 355/326 |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

An image forming apparatus includes a first developing device having a first developer carrying member for supplying a first color toner in the first developing zone; a first voltage applying device for applying to the first developer carrying member a first oscillating bias voltage which has a first phase of time period t11 for forming a first electric field applying to the first color toner a force away from the first developer carrying member toward the image bearing member and a second phase of time period t21 for forming a second electric field applying to the first color toner a force away from the image bearing member toward the first developer carrying member; a second developing device having a second developer carrying member for supplying a second color toner in the second developing zone; and second voltage applying device intermittently applying to the second developer carrying member a second oscillating bias voltage having a third phase of time period t12 for forming a third electric field applying to the second color toner a force away from the second developer carrying member to the image bearing member and a fourth phase of time period t22 for forming a fourth electric field applying a force to the second color toner away from the image bearing member toward the second developer carrying member, wherein (t11+t21)>(t12+t22), is satisfied.

27 Claims, 5 Drawing Sheets

IMAGE FORMING APPARATUS

FIELD OF THE INVENTION AND RELATED ART

The present invention relates to an image forming apparatus in which plural color toner images are formed on an image bearing member such as an electrophotographic photosensitive member.

In such an image forming apparatus, a first toner image is formed on an image bearing member by a first developing device, and then a second toner image is formed by a second developing device on the image bearing member carrying the first toner image.

From the standpoint of improvement in the tone reproducibility, improvement in the image density and improvement in the line image reproducibility, it is desirable that an oscillating bias voltage in which the maximum voltage and the minimum voltage repeatedly and alternately appear, be applied to each of the developer carrying members of the first and second developing devices. However, in this case, a phase of the electric field appears which tends to return the toner particles constituting the first toner image to the second developing device, in the operation with the second developing device. Therefore, it is desirable to prevent the first toner from mixing into the second developing device.

U.S. Pat. No. 4,679,929 discloses that the amplitude of the oscillating voltage applied to the second developing device is smaller than that of the first developing device. With this apparatus, however, it is difficult to reconcile the demand for high density image or fog prevention and the demand for prevention of the mixture. The U.S. Patent also discloses that the frequency of the oscillating voltage applied to the second developing device is made higher than that of the first developing device. With this structure, it is difficult to reconcile the demand for proper tone reproducibility and the demand for prevention of the mixture.

SUMMARY OF THE INVENTION

Accordingly, it is a principal object of the present invention to provide an image forming apparatus in which high density plural color toner images can be provided, while the toner of a toner image already formed on the surface of the image bearing member is prevented from mixing into a subsequent developing device in operation.

It is another object of the present invention to provide an image forming apparatus in which plural color toner images having high reproducibility of line images can be produced, while the mixture of different color toner is effectively prevented.

It is a further object of the present invention to provide an image forming apparatus in which plural color toner image having a high reproducibility of line images are formed, while the mixture of different color toner in the developing device can be effectively prevented.

According to an aspect of the present invention, an oscillating period of a second oscillating bias voltage applied to the developer carrying means of the second developing device, constituted by opposite direction electric field phases, is shorter than an oscillating period of a second bias voltage applied to the developer carrying member of the second developing means, constituting opposite direction electric fields, by which the introduction of the first toner into the second developing device is prevented.

In another aspect, the second oscillating bias voltage is intermittently applied to the developer carrying member of the second developing device. By doing so, the mobility of the second toner responsive to the second oscillating bias voltage is improved (the second toner is less mobile than the first toner in the first oscillating bias voltage). Therefore, the tone reproducibility, the line reproducibility and the image density of the second toner image can be improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
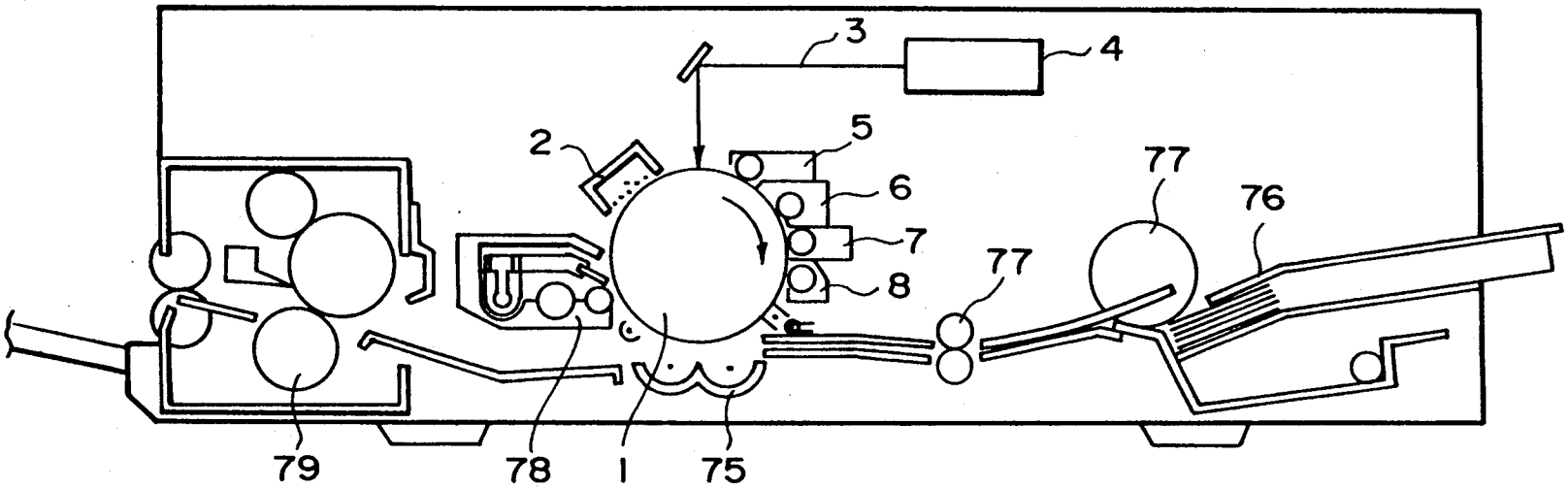
FIG. 2 is a sectional view of an image forming apparatus according to an embodiment of the present invention.

Referring first to FIG. 2, there is shown an image forming apparatus according to an embodiment of the present invention, therein an electrophotographic photosensitive drum 1 rotates in the direction indicated by an arrow. As will be described hereinafter, first, second, third and fourth developing zones A1, A2, A3 and A4 are disposed in the order named in a direction of the movement of the surface of the photosensitive drum 1.

The surface of the photosensitive drum 1 is uniformly charged by a charger 2, in the form of a corona discharger or the like with a grid, and is exposed to a scanning laser beam 3 modulated in accordance with the image to be recorded in a first color, so that a first electrostatic latent image is formed on the photosensitive drum 1. The optical means 4 for forming the laser beam for scanning the photosensitive drum 1 may be of a known type.

The first electrostatic latent image is reverse-developed by a developing device 5 into a first toner image. The surface of the photosensitive drum 1 carrying the first toner image is charged again by the charger 2, and is exposed again to a scanning laser beam 3 modulated in accordance with the image to be recorded in the second color. By doing so, the second electrostatic latent image is formed on the photosensitive drum 1 surface carrying the first toner image.

The second electrostatic latent image is reverse-developed by the developing device 6 into a second toner image on the surface of the photosensitive drum 1 already carrying the first toner image.

As desired, the same steps are repeated, so that a plurality of color toner images are formed on the surface of the photosensitive drum, and thereafter, the toner images of the plural colors are simultaneously transferred onto a transfer sheet. Thus, the plural color toner images superimposed on the surface of the photosensitive drum are transferred simultaneously onto the transfer sheet 76 while the transfer sheet 76 passes through a transfer station a single time, rather than transferring the first color toner image onto the transfer material and thereafter transferring the second toner image onto the same transfer sheet returned to the transfer station. The transfer sheet 76 is sent to the transfer station having the transfer charger 75 by a roller 77, and the transfer sheet after receiving the toner image is supplied to a toner image fixing device 79, from which it is discharged to the outside of the image forming apparatus.

The surface of the photosensitive drum 1, after the plural color toner image is transferred onto the transfer sheet 76, is cleaned by a cleaning device 78.

Figure 3:
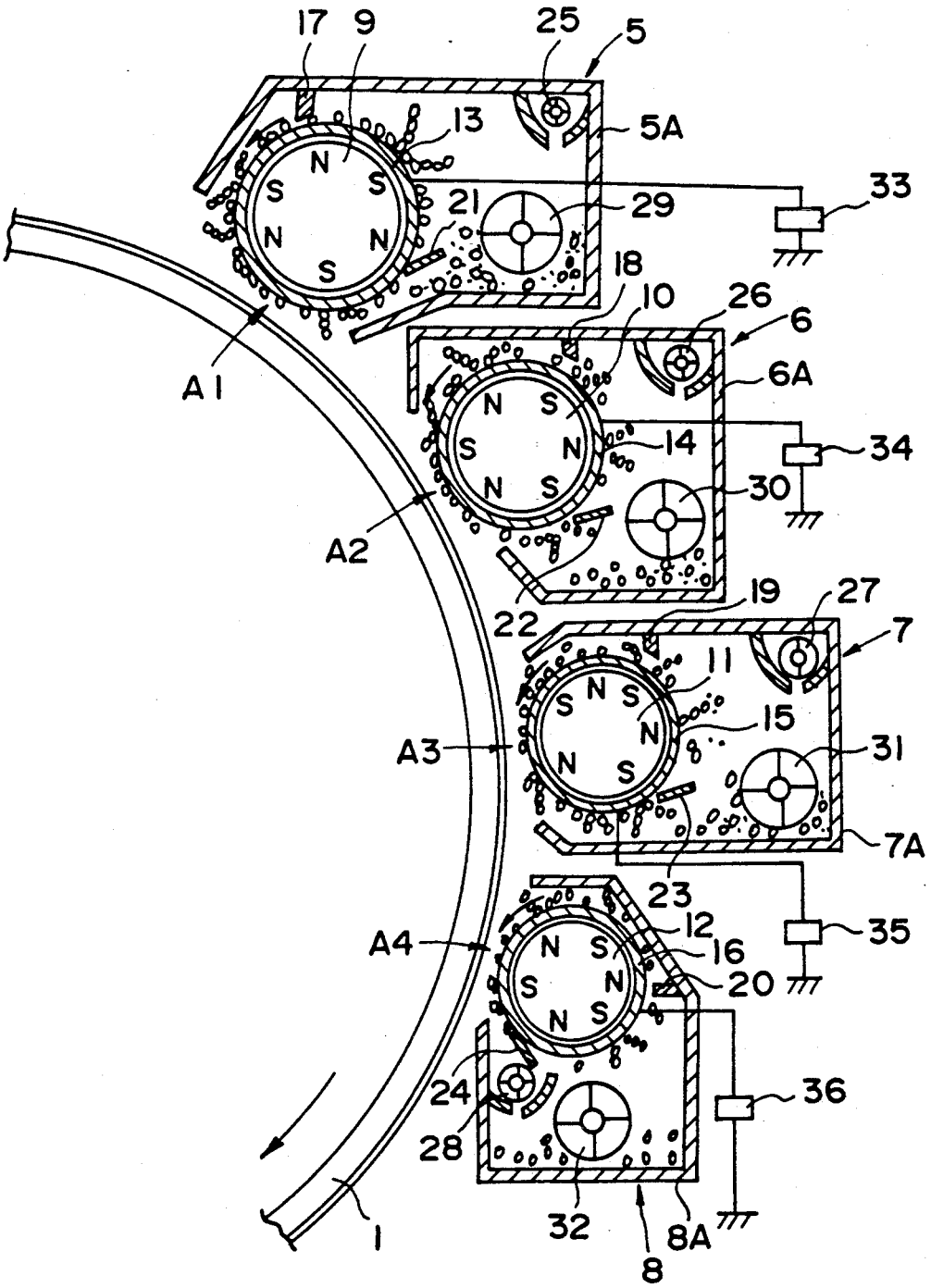
FIG. 3 is a sectional view of a major part of the apparatus of FIG. 2.

As shown in FIG. 3, the developing devices 5, 6, 7 and 8 comprise non-magnetic developing sleeves 13, 14, 15 and 16 containing therein magnets 9, 10, 11 and 12, respectively. The developing sleeves 13, 14, 15 and 16 are faced to the surface of the photosensitive drum 1 in the respective developing zones, and are partly contained in the developer container 5A, 6A, 7A and 8A, respectively. The developing sleeves 13, 14, 15 and 16 are rotatable in the counterclockwise direction to carry the respective toner particles to the associated developing zone where the toner particles are supplied to the photosensitive drum 1. In each of the developing zones, there is a minimum clearance position between the associated sleeve and the photosensitive drum 1. Around the respective developing sleeves, there are regulating blades 17, 18, 19 and 20 for regulating the thickness of layers of the developer particles on the associated developing sleeves, and scraping blades 21, 22, 23 and 24 for scraping the developer off the associated developing sleeves.

In each of the developer containers, a two component developer comprising non-magnetic toner and magnetic carrier particles, is contained. The toners in the developing devices 5, 6, 7 and 8, are yellow, magenta, cyan and black toners, respectively.

In each of the containers, there is a toner supply screw 25, 26, 27, 28 for supplying the toner to the sleeve, and a stirring screw 29, 30, 31, 32 for starting the associated developer.

The magnetic carrier particles 37 have an average particle size of 30–100 microns, preferably 40–80 microns, a resistance of not less than $10^7$ ohm.cm and not more than $10^{12}$ ohm.cm, preferably not less than $10^8$ ohm.cm and not more than $10^{10}$ ohm.cm. An example of such magnetic carrier particles includes ferrite particles (maximum magnetization of 60 emu/g) coated with very thin resin material.

In the measurement of the resistance of the magnetic particles, use is made of a sandwich type cell having a measuring electrode area of 4 $cm^2$ and a gap between electrodes of 0.4 cm, and 200 V is applied across the electrodes while 1 kg is applied to one of the electrodes. The resistance of the magnetic particles is determined on the basis of the current flowing through the circuit.

To the developing sleeves 13, 14, 15 and 16, bias power sources 33, 34, 35 and 36 are connected respectively, each of which includes an AC source having a peak-to-peak to 100 V–3 KV and a frequency of 100 Hz–4 KHz, for example, and a DC source providing a voltage not more than 1 KV, for example. Thus, each of the sleeves is supplied with an oscillating bias voltage in the form of a DC biased AC voltage, which is a voltage oscillating across 0 V, within a positive side only or within a negative side only and which may be in the form of a sine wave, a rectangular wave, a triangular wave of the like. By doing so, an oscillating electric field having a alternately reversing direction is formed in each of the developing zones A1, A2, A3 and A4. Between the developing sleeve and the photosensitive drum, a small clearance is provided. The minimum clearance is not more than 1 mm, for example.

The thickness of the developer layer on the developing sleeve in the developing zone is smaller than the minimum clearance between the sleeve and the photosensitive drum 1. In other words, the regulating blades 17, 18, 19 and 20 regulate the thicknesses of the developer layer on the associated sleeves so as to satisfy it. Thus, the developing devices are of a non-contact type, for the purpose of not scraping the already formed toner image or images in each of the developing devices 5, 6, 7 and 8.

Figure 1:
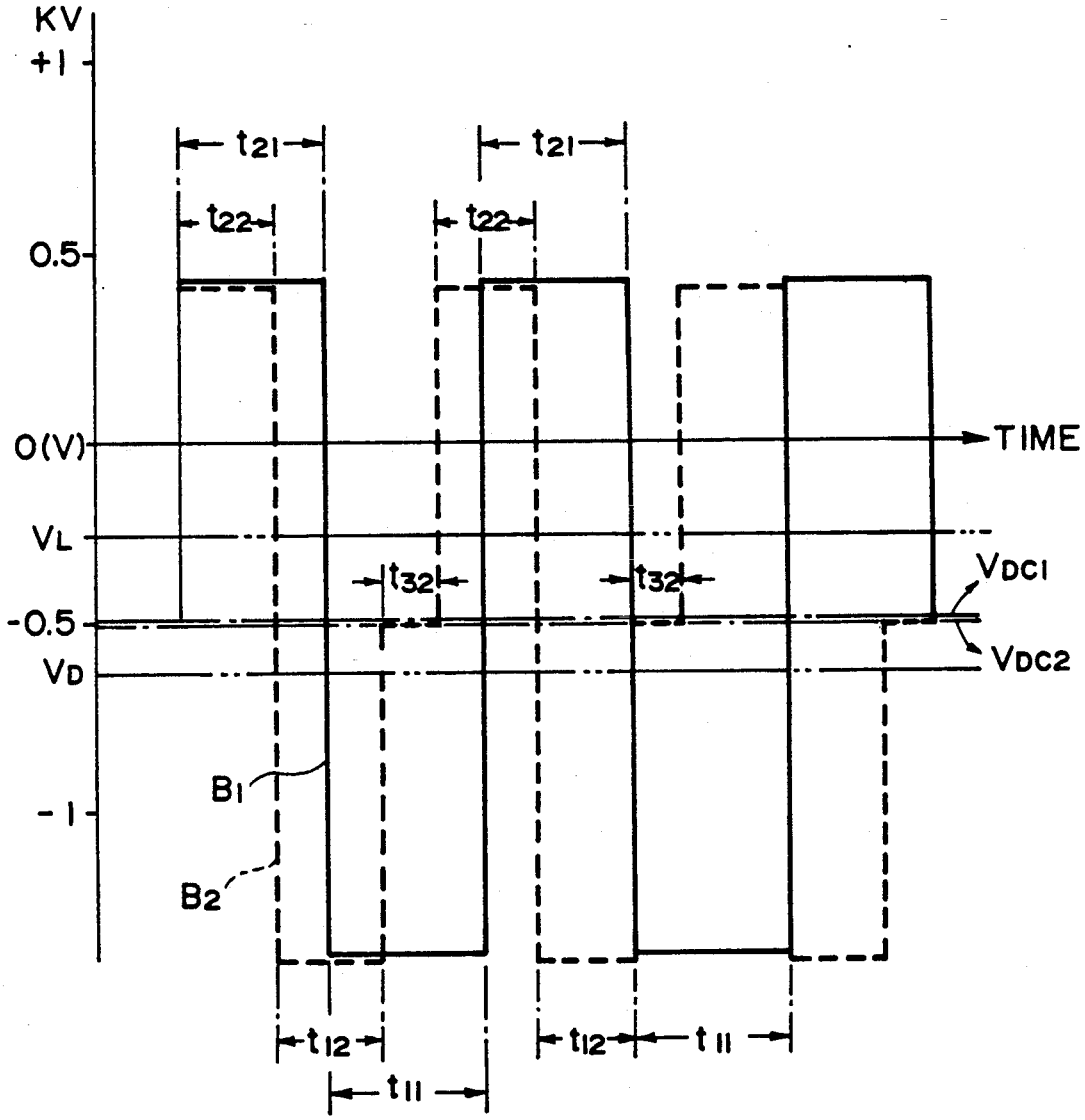
FIG. 1 shows the waveforms of the first and second bias voltage in an embodiment of the present invention.
Figure 4:
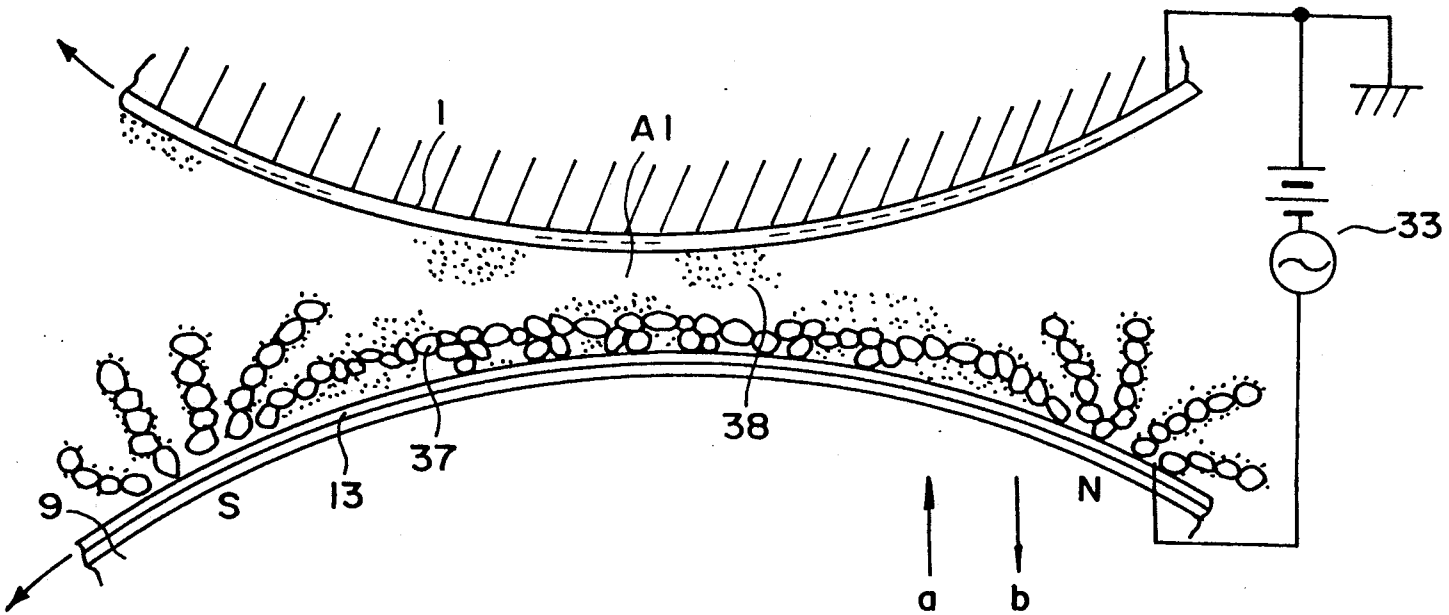
FIG. 4 is an enlarged sectional view of a developing zone of the apparatus of FIG. 2.

Referring to FIGS. 4 and 1, the behavior of the developer in the developing zone will be described in detail. The developing devices have similar structures and, therefore, the description will be made as to the developing device 5, as a typical example.

The photosensitive drum 1 carries the electric charge constituting the latent image. In this embodiment, the charge constituting the electrostatic latent image has a negative polarity. The toner particles 38 are electrically charged to the negative polarity by the friction with the carrier particles 37 so as to effect a reverse-development, in which the toner is deposited in the region subjected to the light projection, that is, the light potential region, for visualization. In this embodiment, the photosensitive drum 1 and the developing sleeve 13 rotate in the same direction in the developing zone A1, but they may be rotated in opposite directions. In the space therebetween, an electric field is formed by the bias voltage source 33.

Upstream of the position where the photosensitive drum 1 and the developing sleeve 13 are closest, there is a magnetic pole N having an N polarity, and downstream thereof there is a magnetic pole S having an S polarity. The polarities may be exchanged. In any event, a pair of magnetic poles having different polarities are disposed closely to each other, by which a magnetic field having a strong component in the tangential direction along the peripheral surface of the sleeve is formed in the developing zone. Thus, as shown in FIG. 4, the magnetic carrier particles 37 are formed into chains along the surface of the sleeve. In other words, the chains of the carrier particles 37 line along the sleeve surface, so that a very thin layer of the two component developer is formed in the developing zone A1 without contacting the photosensitive drum.

Since the amount of developer supplied into the developing zone A1 is small, the density of the magnetic carrier particle chain is not very high, and the toner particles are supplied both from the surfaces of the carrier particles and the sleeve surface, the latter being movable through the space among the chains of the carrier particles. Because application of the oscillating electric field provides high development efficiency, a toner image having sufficient image density can be provided by a thin developer layer.

As shown in FIG. 1, in this embodiment, the latent image has a negative polarity potential both in the image portion potential VL to receive the toner (the light potential region subjected to the light application) and in the non-image portion potential VD (the dark portion potential not subjected to the light application). However, the absolute value of the non-image portion potential VD is higher than that of the image portion potential VL. The toner is charged to a negative polarity. The direction of the electric field in the developing zone alternately changes in the space between the photosensitive drum and the developing sleeve, as indicated by arrows a and b in FIG. 4. However, in the phase t11 (see FIG. 1), in which the developing sleeve 13 is supplied with a negative component of the oscillating bias voltage B1, the direction of the electric field is as indicated by b.

Onto the carrier particles having the electric resistance described hereinbefore, a negative electric charge is induced from the sleeve at this time. Since the direction of the electric field is as indicated by b, the carrier particles receive a force in the direction a which is opposite from the direction b. Therefore, the chains bulge generally toward the drum. This promotes the release of the toner particles from the chains and from the surface of the sleeve. Since the toner particles deposited on the surface of the sleeve and on the surfaces of the magnetic particles, are charged to the negative polarity, they receive a force in the direction a by a electric field having the direction b in the clearance, and are deposited on the photosensitive drum 1.

In the phase t21 (see FIG. 1), in which the positive component of the oscillating bias voltage B1 is applied to the developing sleeve 13, the direction of the electric field formed in the developing zone (allow a) is opposite to the direction of the electric field b. The electric field having the direction a is effective to shrink the chains by a force in the direction b, so that they contact the developing sleeve.

On the other hand, the toner particles on the photosensitive drum are negatively charged as described hereinbefore. Therefore, they receive forces in the direction b by the electric field having the direction a. Thus, in the phase t21, the toner deposited on the drum 1 receives a force away from the drum 1 toward the developing sleeve, by which a part of the toner is returned onto the sleeve from the drum. The phases t11 and t21 are alternately repeated, so that the developer particles reciprocate alternately in the directions a and b. With the increase of the clearance between the sleeve 13 and the drum 1 with the rotation of the sleeve, the developing operation is completed. At the time of completion, an amount of the toner which corresponds to the electrostatic latent image remains on the photosensitive drum. That is, the toner image is formed now.

In this embodiment, since the developing action is a reverse-development action, the toner is deposited on the light potential VL region, and the dark potential VD region is substantially free from toner deposition. That is, the latter region is the background region.

As shown in FIG. 1, the potentials VL and VD are between the maximum level and the minimum level of the oscillating bias voltage. In FIG. 1, VDC1 and VDC2 have a DC component added to the AC component. These voltages are preferably between the potentials VD and VL from the standpoint of the production of a foggy background. The voltage VDC1 is the DC voltage component of the oscillating bias voltage B1 applied to the sleeve 13 of the first developing device 5; and VDC2 is a DC component of the oscillating bias voltage B2 (which will be described hereinafter) applied to the sleeve 14 of the second developing device 6.

The sleeve 13 of the first developing device 5 is supplied with the oscillating bias voltage B1 in which the phases t11 and t21 are continuously repeated without interruption at least from the start of the development to the completion of the development in one complete image.

Mixture of the developers, which is a problem with conventional apparatus, has stemmed from the reverse movement of the first toner from the photosensitive drum to the developing sleeve during the developing operations for the second and subsequent colors.

In an attempt to avoid the problem, a proposal has been made in which the frequency of the developing bias B2 applied to the sleeve 14 of the second developing device 6 is increased, or the amplitude of the voltage is reduced. However, if this is introduced so as to prevent the developer mixture in the second and subsequent developing operations, the tone reproducibility of the development decreases with the result of hard-feeding images and poor reproducibility of fine line images. It is understood that this is because, with the increase of the frequency of the oscillating bias voltage, the response of the reciprocating motion of the developer to the frequency decreases in the developing zone between the photosensitive drum and the developing sleeve therefore, the developer is not deposited in accordance with the potential of the latent image. Amplitude reduction enhances this.

In the embodiment of the present invention, the oscillating developing bias voltage is applied intermittently to the sleeve of the second developing device, by which developer mixture is prevented, and the reduction of the response of the toner motion is decreased, so that the deposition of the second toner is made responsive to the latent image.

In FIG. 1, the oscillating bias voltage B2, which is applied to the developing sleeve in the second and subsequent developing operations, indicated by the broken lines, is used in the embodiment of this invention. The oscillating bias voltage B2, similarly to the oscillating bias voltage B1, alternately repeats the phase t12 (time period) in which the electric field (direction b) is formed urging the toner away from the sleeve toward the drum and a phase t22 (time period) in which the electric field (a) in which the toner is urged in the direction away from the drum toward the sleeve.

As will be understood from the Figure, one oscillating period (t22+t12) of the oscillating developing bias voltage B2 having the above-described two phases, is shorter than one oscillating period (t21+t11) of the oscillating developing bias voltage B1 having the two phases. This is equivalent to the frequency of the oscillating bias voltage B2 being higher than that of the oscillating bias voltage B1. Therefore, mixture of the first toner into the second developing device can be prevented.

As shown in the Figure, $t22<t21$, and $t12<t11$ are preferable. In the Figure, $t11=t21$, and $t12=t22$.

Accordingly, the oscillating period of the oscillating bias voltage B2 (t22+t12) is shorter than the oscillating period of the oscillating bias voltage B1 (t21+t11). Therefore, the frequency response nature of the toner motion with the oscillating bias voltage decreases with the result that the reciprocal motion of the toner between the photosensitive member and the developing sleeve in the developing zone is not so fierce. Therefore, the first toner image is not disturbed, thus preventing the first toner from mixing into the second developing device.

However, when the frequency is high and the potential of the latent image on the photosensitive member is low, the second toner particles only repeat the short reciprocating motion and, therefore, are not easily deposited on the photosensitive drum. For this reason, the resultant image density is not sufficient, and the line image is thinner. On the other hand, when the potential of the latent image is high, the second toner particles are abruptly deposited on the photosensitive drum from a predetermined potential level, with the result that the inclination of a density curve relative to the potential of the latent image is steep, (steep γ-property).

In view of this, in this embodiment of the present invention, the oscillating bias voltage waveform is intermittently applied to the sleeve 14 of the second developing device 6 during the period from the start of the developing operation to the completion thereof for one complete image. This promotes the deposition of the second toner onto the image portion of the latent image by the electric field provided by the potential of the second latent image on the photosensitive drum 1, during the intermittent period (t32). Therefore, in accordance with the latent image potential, the γ-curve becomes less steep. In addition, the density of the second toner image and the sharpness of the line image, are improved. During the intermittent period (t32), it is preferable that the sleeve 14 of the second developing sleeve 6 be supplied with the DC component (VDC2). In other words, during the rest period t32, the AC voltage component of the oscillating bias voltage B2 is not applied to the sleeve 14, but only the DC component is applied. This is for the purpose of preventing the production of the foggy background by the second toner.

In the rest period t32 of the application of the oscillating bias voltage B2 to the sleeve 14, the electric field for transferring the first toner image back to the sleeve 14, is not produced. Therefore, the introduction of the first toner into the second developing device 6 can be prevented more assuredly.

Thus, the oscillating bias voltage B2 is applied to the sleeve 14 with the predetermined intermittent periods. The application period of the oscillating bias voltage to the developing sleeve between a certain rest period t32 and the next rest period t32, is properly determined by one skilled in the art in consideration of the amount of developer supply to the developing zone A2, the amount of charge of the developer, the clearance between the developing sleeve 14 and the drum 1, the strength of the electric field and/or the other developing conditions. In the example of FIG. 1, the application period is the one oscillating period of the waveform. Generally, in order to prevent the reduction of image density, tone reproduction or line image reproduction, the sleeve may be supplied with an oscillating bias voltage in 1-5 oscillating periods, between a certain rest period t32 and the next rest period t32.

The length of one rest period is determined properly by one skilled in the art in consideration of the above mentioned developing conditions. In the example of FIG. 1, the rest period t32 has a length which is ¼ of the oscillating period of the oscillating bias voltage B2. Generally, from the standpoint of preventing the mixture of the previous toner into the subsequent developing device without deteriorating the image density, the tone reproducibility and the line image reproducibility, it is desirable that the rest period is ⅛-2 times the oscillating period of the oscillating bias voltage.

The intermittent period may be the same in each of the second and subsequent developing devices 6, 7, and 8. However, it is desirable that the frequency of the oscillating bias voltage is made higher and higher in the subsequent developing steps. More particularly, the frequency of the third oscillating bias voltage B3 applied to the sleeve 15 is made higher than the frequency of the second oscillating bias voltage B2, and the frequency of the fourth bias voltage B4 applied to the sleeve 16 is made higher than the frequency of the third oscillating bias voltage B3. However, it is desirable that the rest period of the oscillating bias voltage applied to the sleeve is made longer and longer in the subsequent developing steps. This is because, if the number of reciprocal motions of the toner particles in the developing steps is the same, the respective developed images have good tone reproducibility (γ). In consideration of the above, when four color toner development is carried out, the following conditions are preferable:

$$(t21+t11)>(t22+t12)>(t23+t13)>(t24+t14) \quad (1)$$

$$t32 \leqq t33 \leqq t34 \quad (2)$$

where t13 and t14 are the phase periods of the b direction electric field of the third oscillating bias voltage B3 applied to the sleeve 15 and the fourth oscillating bias voltage B4 applied to the sleeve 16, respectively; and t23 and t24 are the same for the a direction electric field; t33 is the rest period of the third oscillating bias voltage B3; and t34 is the rest period of the fourth oscillating bias voltage B4.

The first oscillating bias voltage B1 applied to the sleeve 13 of the first developing device may be intermittently applied with the rest periods.

As will be understood from FIG. 1, the interruption of the oscillating bias voltage application to the sleeve is preferably started at the point of time of completion of the phase t12 in which the toner receives the force away from the sleeve toward the drum. The reason is as follows: At the point of time of the completion of the phase t12, the second toner particles have an inertia toward the drum and, therefore, a small amount of second toner particles move to the image portion of the second latent image also during the rest period t32, thus improving the reproducibility of the second toner image. On the other hand, the toner particles of the first toner image were urged to the drum in the phase t12 without the separating direction force applied thereto. Therefore, after the start of the rest period t32, the toner is not easily moved to the sleeve. However, the toner mixture preventing effects is greater than in the conventional art, even if the rest period t32 starts at the completion of the phase t22.

Experimental examples will be described:

EXPERIMENT 1

A device was used as shown in FIG. 3, in which the peripheral speeds of the developing sleeves were 210 mm/sec, and the peripheral speed of the photosensitive drum was 160 mm/sec.

The developing sleeves were made of stainless steel (SUS 316), and each had a diameter of 20 mm. Each of the surfaces of the developing sleeves were sand-blasted with #400 abrasive particles having non-uniform configurations. The magnet had 6 poles in which N poles and S poles were alternatively arranged, as shown in FIG. 3.

The clearance between each of the developing sleeves and the associated developer layer thickness regulating blade ends was 400 microns. The regulating blade was made of non-magnetic stainless steel having a thickness of 1.2 mm in each of the developing devices. The amount of the developer on the developing sleeve was each 40 mg/cm$^2$ when the developer was not erected. The layer of the developer on each of the developing sleeves in the associated developing zones was 300 microns at the position where the clearance between the sleeve and the drum was a minimum.

The minimum clearance between each of the developing sleeves and the photosensitive drum was 500 microns.

The magnetic carrier particles of the developers in the developing devices comprised ferrite particles (maximum magnetization of 60 emu/g) having an average particle size of 60–50 microns and a true density of 5.3 g/cm$^3$, coated with very thin silicone region materials.

The non-magnetic insulative toner comprised 100 parts of polyester resin and about 5 parts of pigment, having an average particle size of 10 microns. The pigments were copper phthalocyanine pigment for blue toner, disazo pigment for the yellow toner, monoazo pigment for the magenta toner. The black toner comprised the above pigments at the ratio of 1:2:1. For the purpose of increasing the fluidity of the toner, collloidal silica (0.5%) was added.

The relation between the weight C of the magnetic carrier particles and the weight T of the toner, $(T/(C+T))\times 100$ was approximately 8–12%. The amount of charge of the first and second toner was approximately $-15$ μcoul/g.

The outside diameter of the photosensitive drum was 160 mm. The photosensitive material was OPC. The electrostatic latent image had a dark portion potential (non-image portion potential) VD of $-650$ V and a light portion potential (image portion potential) VL of $-220$ V.

The bias voltage source 33 produced a rectangular wave AC voltage having a ratio t21/t11 of 1, a frequency f of 2000 Hz, and a peak-to-peak voltage Vpp of 1800 V, which was biased with a DC voltage of $-480$ V. This was for the first oscillating bias voltage applied to the sleeve 13 of the developing device 5.

To the developing sleeve 14 of the second developing device 6, the voltage source 34 produced a second oscillating bias voltage which was the rectangular wave AC voltage of 1800 V having the same peak-to-peak voltage Vpp, biased with a DC voltage of $-500$ V (VDC3).

Here, the ratios t22/t21=1, t21/t22=3/2, and t11/t12 =3/2, were satisfied. The second oscillating bias voltage was applied to the sleeve 14 with the rest period in one another oscillating periods. The rest period t32 was ½ of the oscillating period. That is, t32=t12=t22.

With these conditions, the developing devices 5 and 6 were sequentially operated. The resultant image was clear, and the colors were uniform. In a continuous long term copying operation, it was confirmed that the toner 38 of the developing device 5 did not enter the developing device 6. The tone reproducibility and the line reproducibility were satisfactory.

EXPERIMENT 2

A third developing device 7 was added to the apparatus of Experiment 1 having the two developing devices 5 and 6, and the three color images were superposed.

To the developing sleeves 13 and 14 of the developing devices 5 and 6, the voltages in the first experiment were added. The voltage applied to the developing sleeve 15 of the developing device was an AC voltage of 1800 V having the same peak-to-peak voltage Vpp as with the developing sleeve 13, biased with a DC voltage of $-520$ V. This third oscillating bias voltage was applied from the voltage source 35.

Here, the ratios t23/t13=1, t21/t23=2/1, and t11/t13 =2/1, were satisfied. The third oscillating bias voltage was applied to the sleeve 15 with the rest period of every other oscillating periods. The rest period t33 was ⅔ of the oscillating period.

The results of the experiment were satisfactory without non-uniformity, and it was confirmed that the first and second toners hardly entered the third developing device.

From various experiments, it has been found preferable from the standpoint of producing good image without introduction of different color toner into the developing devices, that the second developing bias B2 satisfies the equation $1<$t21/t22$<5$ and that the third bias B3 satisfies the equation $1<$t21/t23$<10$.

If the amount of the charge of the toner is made smaller and smaller in subsequent developing steps, the image quality was further improved, and the introduction of different color toner into the developing device, can be further prevented. For example, when the T/C ratio, $(T/(C+T))\times 100$ was 9% in the developing device 5, 10% in the developing device 6 and 12% in the developing device 7, the triboelectric charge amounts of the first, second and third toners were $-21$, $-17$ and $-14$ μcoul/g. With these values, the different color toner mixture in the developing devices 6 and 7 could be prevented. The reason is considered as follows: Since the amounts of triboelectric charge of the toners increase toward the prior developing step in absolute value, the toner moved from the developing sleeve for the photosensitive drum and constituting the toner image was electrostatically attracted to the photosensitive drum 1 with larger attracting force. Therefore, under the oscillating electric field in the subsequent developing step, the toner deposited on the drum in the previous developing step is not easily transferred back to the developing sleeve in the subsequent developing step. Since the first and second toners are more strongly attracted to the carrier particles and the sleeves 13 and 14 than in the Experiments 1 and 2, it is desirable that the DC component of the bias voltage applied to the sleeves 13 and 14 be increased by 10–50 V in the absolute value than in the Experiments 1 and 2 for the purpose of applying to the toner the large forces toward the drum in the phases t11 and t12. For example, it is preferable that the DC voltage component of the oscillating bias voltage applied to the sleeve 13 is $-530$ V, and that the DC component of the oscillating bias voltage applied to the sleeve 14 is $-570$ V.

In any event, the absolute value of the difference between the potential of the image portion of the latent image and the DC voltage component of the oscillating bias voltage, $|VL-VDC|$ is preferably larger in the latter developing sleeves than in the former developing steps. The reason for this is that the oscillating period of the oscillating bias voltage in the latter developing step is shorter than in the former step and; therefore, the toner in the latter developing step, depending on the DC voltage component, is less easily deposited on the image portion of the latent image than in the former developing step. That is, it is preferable that |VL−VDC| is larger in the latter developing step, so that the DC component promotes the deposition of the toner to the image portion of the latent image.

In the developing devices not used for the developing operation, the developing device or devices may be placed away from the photosensitive drum, or an electric bias may be applied so as to prevent the toner movement to the sleeve, by which the toner is prevented from depositing on the photosensitive drum unnecessarily.

The developer may be a one component developer.

Figure 5:
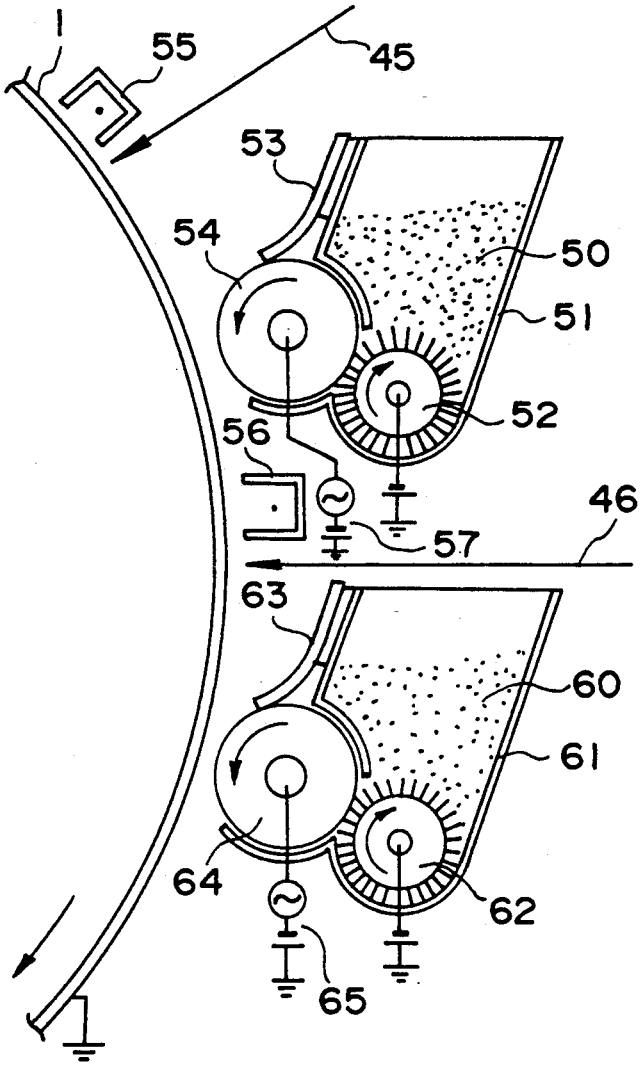
FIG. 5 shows another embodiment of the present invention.

Referring to FIG. 5, another embodiment will be described. The same reference numerals as in the FIG. 2 embodiment are added for the elements having the corresponding functions, and a detailed description thereof is omitted for simplicity.

In this embodiment, between the adjacent developing devices, there are provided recharging means and image exposure means, so that immediately after the development of the first exposed image, the recharging and the second image exposure and the developing operation therefore are carried out.

First and second image exposure beams 45 and 46 are produced by the laser optical system in accordance with a drive instruction signal produced by an image signal controller (not shown) corresponding to first and second image signals. The beams scan the surface of the photosensitive drum 1. In this process, the photosensitive drum 1 is uniformly charged by a primary charger 55, and it is exposed to the first exposure beam 45 so that the first latent image is formed. The first latent image is developed by a developing device 51 containing a black one component non-magnetic developer 50 and disposed close to the photosensitive drum 1. Subsequently, the second charger 56 is operated to charge the surface of the photosensitive drum carrying the first toner image. Then, it is exposed to the second exposure beam 46, so that a second latent image is formed. The second latent image is developed by a developing device 61 containing a red one component non-magnetic developer and disposed close to the photosensitive drum 1. In this manner, the charging, image exposure and developing steps are sequentially carried out so as to form plural color toner images on the photosensitive drum, and these images are transferred at once onto the transfer material.

The black toner 50 and the red toner 60 in the developing devices 51 and 61 are supplied to the developing rollers 54 and 64 by fur brushes 52 and 62. The fur brushes 52 and 62 function not only to stir the toner particles in the developing devices 51 and 61 but also to scrape the toner particles on the developing rollers after the developing operation so as to prevent production of so-called ghost images.

The rollers 54 and 64 rotate in the direction indicated by an arrow to carry the developer into the developing zone. The thickness of the developer layer carried to the developing zone is regulated by the associated regulating blades 53 and 63. The blades 53 and 63 are elastic blades of rubber plates or metal plates. They are contacted to the rollers 54 and 64, respectively, with light pressure and regulate the thicknesses of the developer to be conveyed to the respective developing zones so as to be smaller than the minimum clearance between the drum 1 and the roller 54 and 64. The blades 53 and 63 are effective to rub the toner particles with the developing rollers 54 and 64, respectively, so as to triboelectrically charge the toners.

The developing rollers 54 and 64 are electrically connected with developing bias sources 57 and 65, respectively, so as to form electric fields between the photosensitive drum 1 and the developing rollers 54 and 64, respectively.

The clearance between the photosensitive drum 1 and the developing roller 54 and 64 was approximately 300 microns. The thickness of the toner layer on the developing roller 54 or 64 was approximately 35 microns. The black toner 50 was triboelectrically charged to −18 μcoul/g, and the red toner 60 was triboelectrically charged to −14 μcoul/g.

The dark portion potential (non-image portion potential) VT of the first latent image was −620 V, and the light portion potential (image portion potential) VL was −240 V. The voltage source 57 applied to the developing roller 54 was a first oscillating bias voltage having a ratio t21/t11 of 1, a frequency of 1800 Hz, and a peak-to-peak voltage Vpp of 1400 V (rectangular AC voltage) biased with a DC voltage of −500 V.

The dark portion potential of the second latent image was −650 V, and the light portion potential was −270 V. The second oscillating bias voltage was a rectangular wave AC voltage of 1400 V having the peak-to-peak voltage Vpp of 1400 V, biased with a DC voltage of −550 V. Here, the ratios t22/t12=1, t21/t22=3/2, and t11/t12=3/2, were satisfied. The rest periods were added every other oscillating periods of the second oscillating bias voltage, and the rest period t32 was equal to one oscillating period.

In this embodiment, good images without color non-uniformity were produced, similarly to the foregoing embodiment. In addition, the black toner 50 did not enter the developing device 61.

In this embodiment, the toner is transferred from the developer carrying member to the image bearing member, and the toner is transferred back to the developer carrying member from the image bearing member in the first developing device. However, this is not inevitable. It is a possible alternative that by properly selecting the peak voltage in the phase t21, the toner once transferred onto the image bearing member may be prevented from transferring back to the image bearing member also in the first developing device. However, in any case and with any bias voltage, the light and dark potentials of the latent image are between a peak level of the voltage constituting the electric field in the first a (first peak level) and a peak level of the voltage for constituting the electric field in the direction b (second peak level). In other words, the absolute value of the different between the dark potential and the light potential is smaller than the absolute value of the difference between the first peak level and the second peak level of the bias voltage, that is, peak-to-peak voltage Vpp.

In the foregoing embodiment, the peak-to-peak voltages Vpp of the bias voltages are the same. However, it is a possible alternative that the peak-to-peak voltage Vpp of the oscillating bias voltage applied to the downstream developing device with respect to the rotational direction of the photosensitive drum may be made smaller than the peak-to-peak voltage Vpp of the oscillating bias voltage applied in the upstream developing device.

In the foregoing embodiment, reverse development is taken, in which the toner is deposited on the exposed portion (light potential portion) on the photosensitive surface. However, the present invention is applicable to regular development, in which the toner is deposited on the non-exposure (dark potential) portion. In the case of regular development, the toner is electrically charged to a polarity opposite that of the latent image.

In the foregoing embodiments, the electrostatic latent image has a negative polarity. However, the present invention is applicable to the case in which a positive polarity electrostatic latent image is formed, and it is reverse-developed or regular-developed.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member movable along a first developing zone and a second developing zone downstream thereof;

a first developing device having a first developer carrying member for supplying a first color toner to said image bearing member in the first developing zone to form a first toner image;

first voltage applying means for applying to said first developer carrying member a first oscillating bias voltage which has a first phase of time period t11 for forming a first electric field applying to the first color toner a force away from said first developer carrying member toward said image bearing member and a second phase of time period t21 for forming a second electric field applying to the first color toner a force away from said image bearing member toward said first developer carrying member;

a second developing device having a second developer carrying member for supplying a second color toner to said image bearing member carrying the first toner image in the second developing zone; and second voltage applying means for intermittently applying to said second developer carrying member a second oscillating bias voltage having a third phase of time period t12 for forming a third electric field applying to the second color toner a force away from said second developer carrying member to said image bearing member and a fourth phase of time period t22 for forming a fourth electric field applying a force to the second color toner away from said image bearing member toward said second developer carrying member, wherein $(t11+t21)>(t12+t22)$, is satisfied.

2. An apparatus according to claim 1, wherein the first color toner and the second color toner are electrically charged to the same polarity.

3. An apparatus according to claim 2, wherein said second developing device is a non-contact type developing device.

4. An apparatus according to claim 3, wherein a rest period t32 of the second oscillating voltage applied to the second developer carrying member is 1/5–2 multiplied by the oscillating period of the second oscillating bias voltage.

5. An apparatus according to claim 4, wherein the second oscillating bias voltage application to the second developer carrying member is interrupted for each 1–5 oscillating periods of the second oscillating bias voltage.

6. An apparatus according to any one of claims 1–5, wherein application of the second oscillating bias voltage to said second developer carrying member is interrupted when the third phase is completed.

7. An apparatus according to any one of claims 1–5, wherein $t12<t11$, and $t22<t21$, are satisfied.

8. An apparatus according to claim 7, wherein $t11=t21$, and $t12=t22$, are satisfied.

9. An apparatus according to claim 8, wherein $1<t21/t22<5$, are satisfied.

10. An apparatus according to claim 9, wherein application of the second oscillating bias voltage to said second developer carrying member is stopped when the third phase is completed.

11. An apparatus according to any one of claims 1–5, wherein an amount of electric charge of the second color toner is smaller than that of the first color toner.

12. An apparatus according to any one of claims 3–5, further comprising:

a non-contact type third developing device having a third developer carrying member for supplying a third color toner electrically charged to the same polarity as the first and second toners to said image bearing member carrying the first and second toner images, in a third developing zone downstream of the second developing zone in a direction of movement of said image bearing member; and third voltage applying means for intermittently applying with rest period t33 to said third developer carrying member a third oscillating bias voltage having a fifth phase of time period t13 for forming a fifth electric field applying to the third color toner a force away from said third developer carrying member to said image bearing member and a sixth phase of time period t23 for forming a sixth electric field applying to the third color toner a force away from said image bearing member toward said third developer carrying member, wherein $(t12+t22)>(13+t23)$, and $t32\leqq t33$, are satisfied.

13. An apparatus according to claim 12, wherein the rest period t33 is 1/5–2 multiplied by the oscillating period of the third oscillating bias voltage.

14. An apparatus according to claim 13, wherein application of the third oscillating bias voltage to said third developer carrying member is interrupted for each 1–5 oscillating periods of the third oscillating bias voltage.

15. An image forming apparatus, comprising:

an image bearing member movable along a first developing zone and a second developing zone downstream thereof;

latent image forming means for forming a first electrostatic latent image and a second electrostatic latent image on said image bearing member;

a first developing device having a first developer carrying member for supplying to said image bearing member a first color toner in the first developing zone to form a first toner image;

first voltage applying means for applying to said first developer carrying member a first oscillating bias voltage having a first phase of time period t11 for forming a first electric field applying to the first color toner a force away from said first developer carrying member to said image bearing member and a second phase of time period t21 for forming a second electric field applying to the first color toner a force away from said image bearing member to said first developer carrying member, wherein the first oscillating bias voltage is a combination of a first AC voltage component and a first DC voltage component having a voltage level between an image portion potential of the first electrostatic latent image and the non-image portion potential thereof;

a non-contact type second developing device having a second developer carrying member for supplying a second color toner to said image bearing member carrying the first toner image in the second developing zone to form a second toner image;

second voltage applying means for applying with predetermined periods for each predetermined oscillating period to said second developer carrying member a second oscillating bias voltage having a third phase of time period t12 for forming a third electric field applying to the second color toner a force away from said second developer carrying member toward said image bearing member, a fourth phase of time period t22 for forming a fourth electric field applying to the second color toner a force away from said image bearing member toward said second developer carrying member and a rest period t32, wherein said second oscillating bias voltage is a combination of a second AC voltage component and a second DC voltage component having a voltage level between an image portion potential of the second electrostatic latent image and a non-image portion potential thereof, wherein $(t11+t21)>(t12+t22)$, are satisfied, and wherein in the rest periods, the second AC voltage component is not applied to said second developer carrying member, but the second DC component is applied thereto.

16. An apparatus according to claim 15, wherein the first color toner and the second color toner are electrically charged to the same polarity.

17. An apparatus according to claim 16, wherein a rest period t32 of the second oscillating voltage applied to the second developer carrying member is 1/5 -2 multiplied by the oscillating period of the second oscillating bias voltage.

18. An apparatus according to claim 17, wherein the second oscillating bias voltage application to the second developer carrying member is interrupted for each 1-5 oscillating periods of the second oscillating bias voltage.

19. An apparatus according to any one of claims 15-18, wherein application of the second oscillating bias voltage to said second developer carrying member is interrupted when the third phase is completed.

20. An apparatus according to any one of claims 15-18, wherein an absolute value of a difference between the second DC component and the image portion potential of the second electrostatic latent image is larger than an absolute value of a difference between the first DC voltage component and an image portion potential of the first electrostatic latent image.

21. An apparatus according to claim 20, wherein an amount of electric charge of the second color developer is smaller than that of the first color toner.

22. An apparatus according to claim 20, wherein application of the second oscillating bias voltage to said second developer carrying member is stopped when the third phase is completed.

23. An apparatus according to claim 20, wherein $t12<t11$, and $t22<t21$, are satisfied.

24. An apparatus according to claim 23, wherein $t11=t21$, and $t12=t22$, are satisfied.

25. An apparatus according to claim 23, wherein $1<t21/t22<5$, are satisfied.

26. An apparatus according to claim 25, wherein application of the second oscillating bias voltage to said second developer carrying member is stopped when the third phase is completed.

27. An apparatus according to claim 26, wherein a charge amount of the second color toner is smaller than that of the first color toner.

* * * * *

UNITED STATES PATENT AND TRADEMARK OFFICE

CERTIFICATE OF CORRECTION

PATENT NO. : 5,187,535

DATED : February 16, 1993

INVENTOR(S) : TAJIMA

It is certified that error appears in the above-indentified patent and that said Letters Patent is hereby corrected as shown below:

COLUMN 2

Line 35, "therein" should read --wherein--.

COLUMN 12

Line 54, "first" (first occurrence) should read --direction--.

Signed and Sealed this

Eighteenth Day of January, 1994

Bruce Lehman

*Attest:*

BRUCE LEHMAN

*Attesting Officer*

*Commissioner of Patents and Trademarks*